US008376614B2

(12) United States Patent
Pawloski et al.

(10) Patent No.: US 8,376,614 B2
(45) **Date of Patent: *Feb. 19, 2013**

(54) VENTING DOUBLE ZIPPER AND RECLOSABLE STORAGE BAG USING SAME

(75) Inventors: James C. Pawloski, Bay City, MI (US); Bryan L. Ackerman, Freeland, MI (US); Michael J. Colucci, Saginaw, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1506 days.

This patent is subject to a terminal disclaimer.

(21) Appl. No.: 11/688,431

(22) Filed: Mar. 20, 2007

(65) Prior Publication Data

US 2008/0232722 A1 Sep. 25, 2008

(51) Int. Cl.
*B65D 33/16* (2006.01)
*B65D 33/01* (2006.01)

(52) U.S. Cl. ..... 383/61.2; 383/63; 383/100

(58) Field of Classification Search ..... 383/63, 383/64, 61.2, 100, 103
See application file for complete search history.

(56) References Cited

U.S. PATENT DOCUMENTS

| | | | | |
|---|---|---|---|---|
| 4,532,652 | A * | 7/1985 | Herrington | 383/103 |
| 5,829,884 | A | 11/1998 | Yeager | |
| 5,911,508 | A | 6/1999 | Dobreski et al. | |
| 6,010,244 | A | 1/2000 | Dobreski et al. | |
| 6,231,236 | B1 | 5/2001 | Tilman | |
| 6,299,353 | B1 | 10/2001 | Piechocki et al. | |
| 6,692,147 | B2 | 2/2004 | Nelson | |
| 6,932,509 | B2 | 8/2005 | Shah et al. | |
| 6,955,465 | B2 | 10/2005 | Machacek et al. | |
| 7,004,632 | B2 | 2/2006 | Hamilton et al. | |
| 7,437,805 | B2 * | 10/2008 | Berich | 24/399 |
| 7,674,039 | B2 * | 3/2010 | McMahon et al. | 383/61.2 |
| 8,061,898 | B2 * | 11/2011 | Pawloski et al. | 383/59 |
| 2004/0234171 | A1 | 11/2004 | Dais et al. | |
| 2004/0234173 | A1 | 11/2004 | Saad et al. | |
| 2004/0252915 | A1 | 12/2004 | Nelson | |
| 2005/0235467 | A1 | 10/2005 | Brochardt et al. | |
| 2005/0244083 | A1 * | 11/2005 | McMahon et al. | 383/63 |
| 2007/0183692 | A1 * | 8/2007 | Pawloski | 383/61.2 |

FOREIGN PATENT DOCUMENTS

| | | | |
|---|---|---|---|
| JP | 09024587 | A * | 1/1997 |
| JP | 09094932 | A * | 4/1997 |
| JP | 2000072157 | A * | 3/2000 |
| JP | 2001206457 | A * | 7/2001 |

OTHER PUBLICATIONS

Machine translation of Japanese Document No. 2000-72157. Translated on May 14, 2009.*

* cited by examiner

*Primary Examiner* — Jes F Pascua

(57) ABSTRACT

A reclosable storage bag and zipper tape for use in conjunction with same is disclosed. The reclosable bag includes first and second panels which are sealed about bottom, left, and right edges leaving an open top. The closure system further includes first and second closure assemblies or zippers which can be individually or simultaneously closed to seal the contents within the bag. Even after the first and second zippers are engaged thereby closing the bag, excess air within the bag can be removed simply be manually compressing the bag and thereby forcing the air through the vent apertures provided between the zippers. A valve internal to the closure system may be provided proximate the vent apertures and open upon sufficient application of pressure thereby allowing for air to be evacuated from the bag.

17 Claims, 8 Drawing Sheets

VENTING DOUBLE ZIPPER AND RECLOSABLE STORAGE BAG USING SAME

FIELD OF THE DISCLOSURE

The present disclosure generally relates to storage bags and, more particularly, relates to storage bags using reclosable plastic zippers.

BACKGROUND OF THE DISCLOSURE

Reclosable storage bags are well known, especially with regard to food storage. The bags are generally made of a plastic film and have two sides which are sealed around bottom, left, and right edges leaving the top open. Such material is typically fluid impermeable, relatively inexpensive, and manufactured in transparent form thereby facilitating content identification. Accordingly, plastic bags have become the dominant product of choice in the area of food storage bags.

Such bags are typically closable and substantially sealable. One common approach to provide such features employs closure members at a top edge of the bag having first and second thermoplastic layers folded or heat sealed along the bottom, left, and right edges. The closure members may be provided in the form of interlocking profiles such as those provided by the present assignee under the ZIPLOC® trademark. The interlocking profiles are also typically manufactured from plastic with a first profile including a linear tab adapted to be interlocked with a linear groove of a second profile.

The interlocking profiles can be connected to close the bag by pinching and pulling across the closure members along the length of the top edges. Such motion can be accomplished with the thumb and forefinger of a user or through the use of a sliding element mounted to the interlocking profiles, as is the case with bags provided by the present assignee in connection with its SLIDELOC® trademark.

While such bags have been met with extraordinary commercial success from their inception until the present day, the assignee continues to improve its product offerings. One area which the assignee has identified as grounds for improvement involves the ability to evacuate air from a bag even after closing. While the primary closure found at the top of many plastic bags provides a substantially air tight seal and thus facilitates preservation of contents, air remaining enclosed in the bag after closure enables bacterial growth and therefore hinders the preservation of the freshness of the contents which the bags are intended to maintain.

At the same time, such bags now often include first and second zippers or closure elements at the top of the bag in an effort to improve the sealing capability of the bag. While such an approach often does improve the overall seal afforded by the bag, the additional zipper also makes the removal of excess air from within the bag after sealing more of a challenge.

In light of the foregoing, it would be an advance in the art of bags to provide a bag with first and second closure members to increase the level of sealing capacity within the bag, while at the same time providing a valve for eliminating excess air from the bag even after the bag is at least preliminarily sealed.

SUMMARY OF THE DISCLOSURE

In accordance with one aspect of the disclosure, a bag closure is disclosed comprising a first flange, a second flange, a first zipper, a second zipper, and a valve. The first and second flanges include at least one venting aperture. The first zipper disengagably attaches the first flange to the second flange while the second zipper disengagably attaches the first flange to the second flange. The first and second zippers flank the venting apertures in the first and second flanges. The valve extends between the first and second flange venting apertures.

In accordance with another aspect of the disclosure, a reclosable storage bag is disclosed which comprises a first panel, a second panel, a first closure member, a second closure member, and a vent valve. The first panel includes top, bottom, left, and right edges, while the first panel includes inner and outer surfaces. The second panel includes top, bottom, left and right edges while the second panel includes inner and outer surfaces. The second panel is secured to the first panel along the bottom, left, and right edges of each panel. The inner surface of the first panel is adjacent the inner surface of the second panel when secured thereto. The first closure member includes extended and recessed profiles with the first closure member extended profile being secured to the inner surface of the first panel proximate the first panel top edge, and the first closure member recessed profile being secured to the inner surface proximate the second panel top edge. The second closure member includes extended and recessed profiles wherein the second closure member extended profile is secured to the inner surface of the second panel and the second closure recessed profile is secured to the inner surface of the first panel. The second closure extended and recessed profiles are secured to the inner surface of the first and second panels. The vent valve is positioned between the first and second closure members.

In accordance with another aspect of the disclosure, a bag closure is disclosed comprising a first flange, a second flange, a first closure device, a second closure device, and a valve flap. The first and second flanges have at least one venting aperture therein. The first closure device includes interlocking extended and recessed strips with the extended strip being attached to one of the first and second flanges and the recessed strip being attached to the other of the first and second flanges. The second closure device includes interlocking extended and recessed strips wherein the extended strip is attached to one of the first and second flanges and the second closure device recessed strip is attached to the other of the first and second flanges. The venting apertures in the first and second flanges are between the first and second closure devices. The valve flap is hingedly attached to one of the first and second flanges and movable between open and closed positions.

In accordance with yet another aspect of the disclosure, a reclosable storage bag is disclosed which comprises a first panel, a second panel, and a bag closure. The second panel is secured to the first panel along left, bottom, and right edges leaving an open top edge. The bag closure is secured across the top edge and includes a first flange having at least one venting aperture therein, a second flange having at least one venting aperture therein, a first zipper disengagably attaching the first flange to the second flange, a second zipper disengagably attaching the first flange to the second flange with the first and second zippers flanking the venting apertures in the first and second flanges, and a valve extending between the first flange venting aperture and the second flange venting aperture.

In accordance with another aspect of the disclosure, a method of closing a reclosable storage bag is disclosed comprising, providing a bag having a first panel and a second panel secured to the first panel along left, bottom, and right edges leaving an open top and edge, a first zipper attached to the first and second panels proximate the top edge, second zipper attached to the first and second panels proximate the first zipper, and vent apertures provided within the first and second panels between the first and second zippers, closing the first zipper, venting the air from the bag through the apertures, and then closing the second zipper.

These and other aspects and features of the disclosure will become more apparent upon reading the following detailed description when taken in conjunction with the accompanying drawings.

Figure 1:
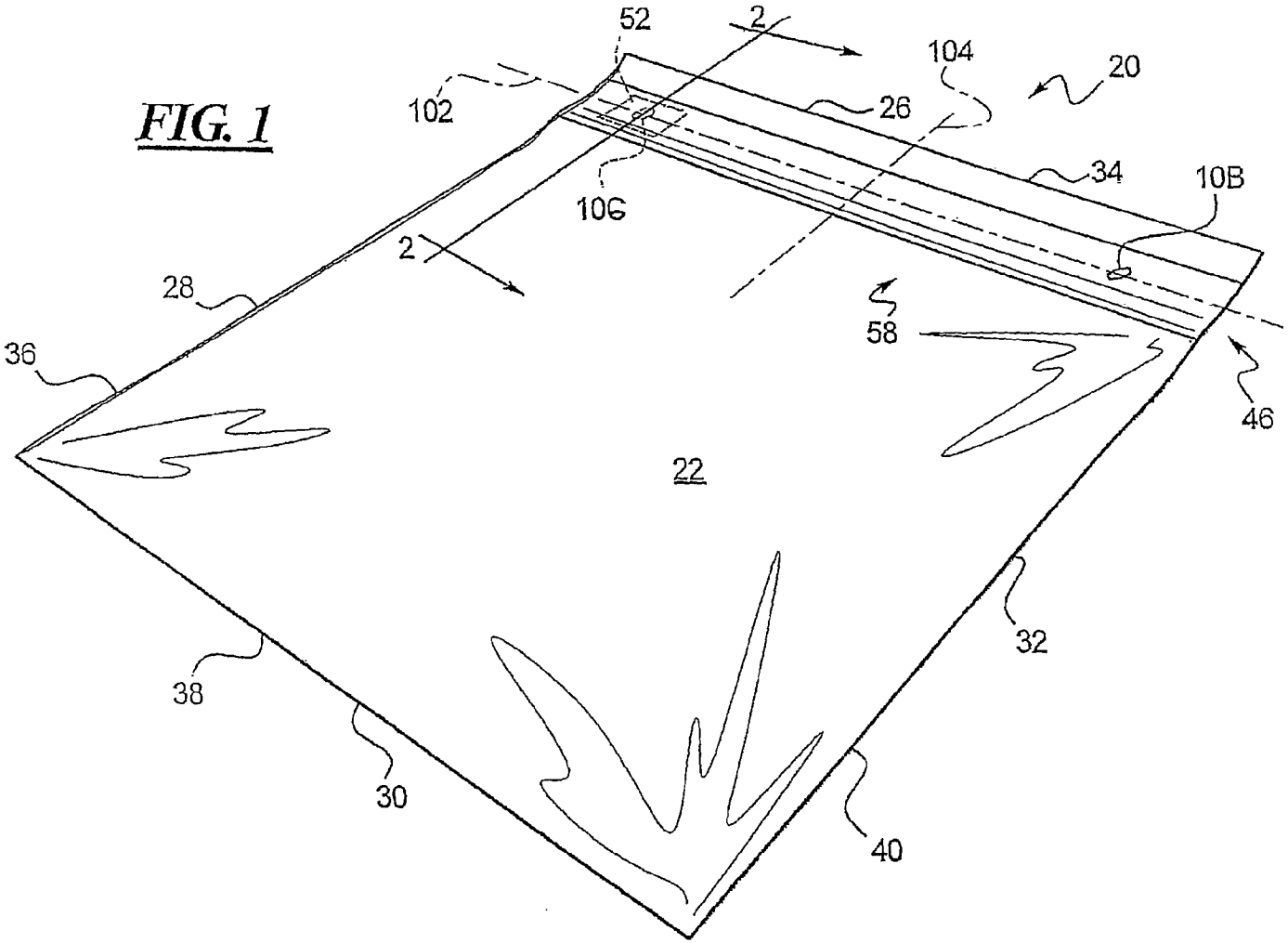
FIG. 1 is a perspective view of a bag constructed in accordance with the teachings of the disclosure.

While the present disclosure is susceptible to various modifications and alternative constructions, certain illustrative embodiments thereof have been shown in the drawings and will be described in detail below. It is to be understood, however, that there is no intention to limit the present invention to the specific forms disclosed, but on the contrary, the intention is to cover all modifications, alternative constructions, and equivalents falling within the spirit and scope of the present invention.

DETAILED DESCRIPTION OF THE DISCLOSURE

Referring now to the drawings, and with specific reference to FIG. 1, a reclosable storage bag constructed in accordance with the teachings of the disclosure is generally referred to by reference numeral 20. While the following description is made in conjunction with such reclosable bags and specifically for use in conjunction with food storage bags, it is to be understood that the teachings of the disclosure are not limited to such bags but can be employed in any application wherein it is desired to seal a compartment but still allow for evacuation of air and fluid from within the compartment after the closure or seal has been made. In addition, while the bag depicted is of a conventional size, and marketed by the present assignee under its ZIPLOC® trademark, it is to be understood that it can be used in conjunction with other types of bags such as those employing a slider on the zipper itself and marketed under the assignee's SLIDELOC®, as well as ZIPLOC® BIG BAGS™ or other large storage bags also marketed under the assignee for outdoor use, clothing storage, or the like.

Figure 2:
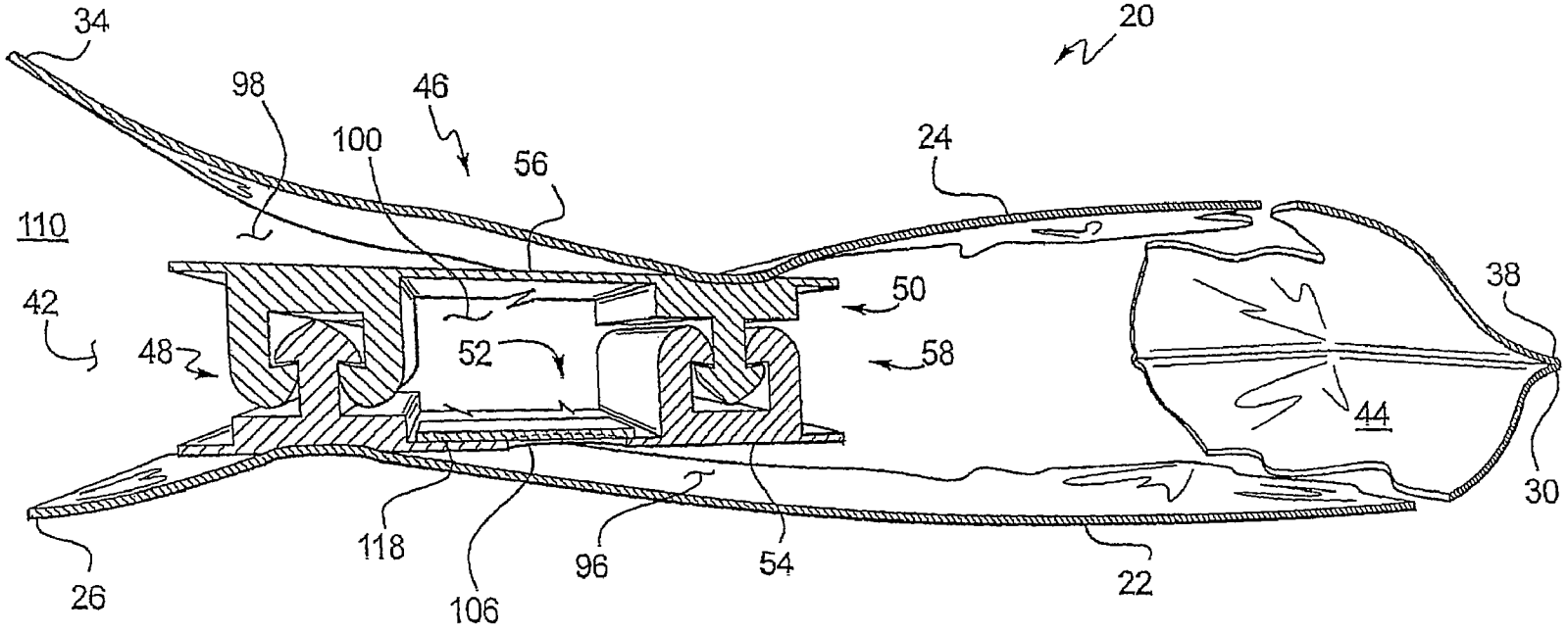
FIG. 2 is a sectional view of the bag of FIG. 1, taken along line 2-2 of FIG. 1.

Referring to FIGS. 1 and 2, the bag 20 is shown to include a first panel 22 and a second panel 24. The first panel 22 includes a top edge 26, a left side edge 28, a bottom edge 30, and a right side edge 32. Similarly, the second panel 24 includes a top edge 34, a left edge 36, a bottom edge 38, and a right edge 40. As shown in FIG. 1, as well as FIGS. 2 and 3, the first panel 22 is connected to the second panel 24 along three of the four edges of the each panel. More specifically, the left edge 28 is connected to the left edge 36, the bottom edge 30 is connected to the bottom edge 38, and the right edge 32 is connected to the right edge 40. This connection can be made by a number of different mechanisms including sealing with a heated knife or the like. As one of ordinary skill in the art will readily recognize, such bags are typically manufactured by way of extrusion and at a conclusion of the manufacturing process, the bags can be cut and folded into appropriate orientation with the edges then being sealed together by pressing them between heated knives or the like. In other embodiments, a separate adhesive may be employed.

In so forming the bag 20, it can be seen that an opening 42 is formed by which an interior storage space 44 can be accessed. In other words, a top edge 26 and top edge 34 can be pulled apart to the extent allowed by the sealed left edges 28 and 36 and right edges 32 and 40, food or other contents can be loaded into the interior storage space 44, and then the top edges 26 and 34 can be brought together again to close the bag 20. In order to effectively seal the bag 20 and thus maintain the contents within the interior storage space 44, as well as the freshness thereof, a closure system 46 is provided.

Figure 3:
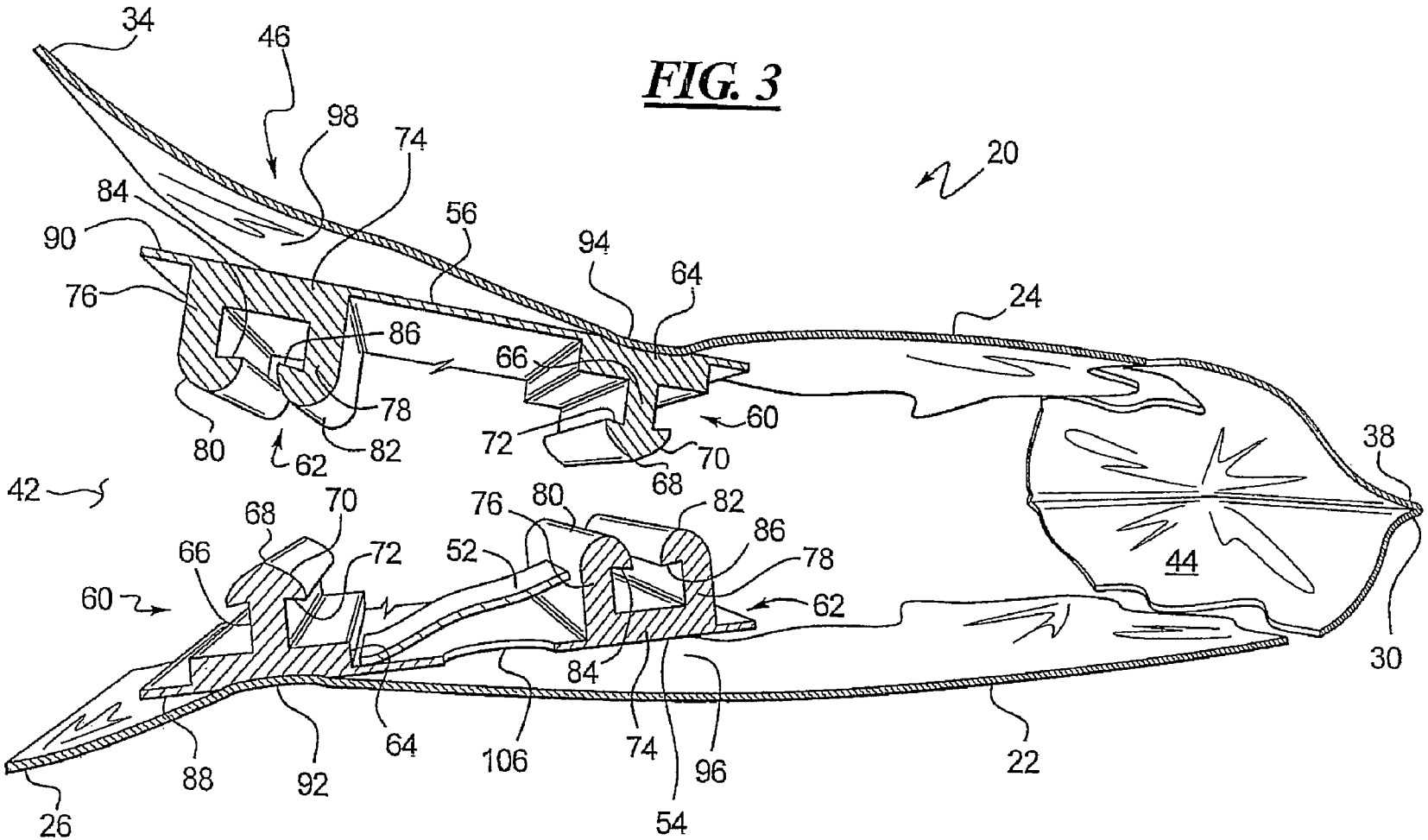
FIG. 3 is a sectional view similar to that of FIG. 2, but depicted with the bag in an open configuration.
Figure 4:
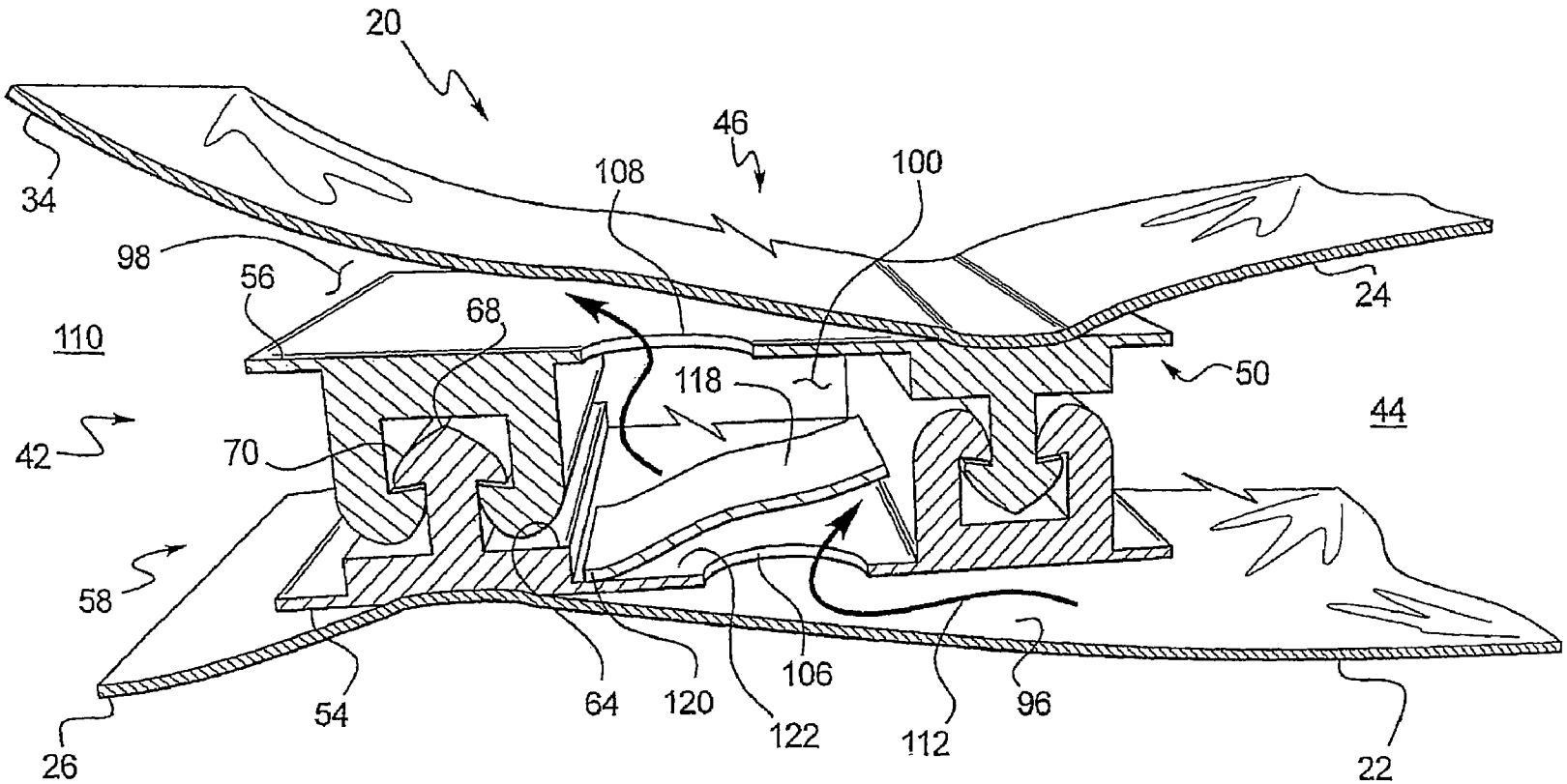
FIG. 4 is an enlarged sectional view of a closure of a first embodiment according to the teaching of the present disclosure.

A first embodiment of the closure system 46 is depicted in FIGS. 2-4. Generally, the closure system 46 includes a first closure assembly or zipper 48, a second closure assembly or zipper 50, and a valve 52 therebetween. In addition, it will be noted that the first closure assembly, second closure assembly 50 and valve 52 are all mounted on first and second flanges 54 and 56 thereby forming zipper tape 58. In other embodiments, a valve need not be provided, only venting apertures.

Referring now in more detail to FIG. 3 and the first closure assembly or zipper 48, it is shown to include an extended profile 60, and a recessed profile 62. Any number of different shapes for the extended and recessed profiles 60 and 62 can be employed within the scope of the present disclosure. However, in the depicted embodiment, the extended profile 60 includes a mounting base 64 from which an appendage 66 outwardly extends. The appendage 66 terminates in a head 68 having cusps 70 forming shoulders 72 with the appendage 66. With respect to the recessed profile 62, it is shown to also include a mounting base 74 from which first and second appendages 76 and 78 outwardly extend. Each appendage 76 and 78 terminates in a head 80 and 82, respectively, and forms a shoulder 84 and 86, respectively, in combination with the first and second appendages 76 and 78, respectively. The extended and recessed profiles 60 and 62 can be manufactured from extruded plastics and are of such a dimension to allow for certain degree of deflection.

Accordingly, in a comparison between FIGS. 2 and 3, it can be seen that the extended and recessed profiles 60 and 62 can be pushed together to close the bag 20 as depicted in FIG. 2, and pulled apart to open the bag as shown in FIG. 3. In other words, the appendages 66, 76 and 78 are able to deflect or move apart to a degree sufficient to allow for the extended and recessed profiles 60 and 62 to interconnect and disconnect. More specifically, when it is desired to close the bag, the extended profile 60 is pushed against the recessed profile 62 as between the thumb and forefinger of a user. Such digital pressure between the two profiles 60 and 62 is sufficient to deflect the appendages 76 and 78 of the recessed profile 62 apart thereby allowing for passage of the appendage 66 of the extended profile 60. While not depicted, it is to be understood that the bag 20 could also include a slider element on one or both zippers 48 and 50. Such a slider would include cam surfaces to push the profiles together when moved in a first direction, and plow surfaces to push the profiles apart when moved in the opposite direction. The sliders used by the assignee under its SLIDELOC® trademark are one example of a suitable slider.

The shoulders 72, 84 and 86 formed by the extended and recessed profiles 60 and 62 provide structure for temporarily locking the extended and recessed profiles 60 and 62 together. More specifically, once the head 68 of the extended profile 60 passes the shoulders 84 and 86 of the recessed profile 62, the appendages 76 and 78 of the recessed profile are able to snap back into their original configuration until the heads 80 and 82 of the appendages 76 and 78 engage the appendage 66 of the extended profile 60. When in such a position, the shoulder 72 of the extended profile and shoulders 84 and 86 of the recessed profile 62 are engaged and thereby temporarily lock the extended profile 60 to the recessed profile 62 until again sufficient force is applied to pull them apart as by user grasping the top edges 26 and 34 of the bag and pulling laterally apart. In so doing, it will be understood that the head 68 of the extended profile 60 pushes the first and second appendages 76 and 78 of the recessed profile 62 apart to a degree sufficient to allow the head 68 to pass the shoulders 84 and 86 of the recessed profile 62. Thus the open position depicted in FIG. 3 is reached. While not depicted, in certain embodiments, the top edges 26 and 34 may include handles to facilitate opening. The handles may be of the type of handle already employed by the assignee in connection with its ZIPLOC® BIG BAGS™ brand bags.

Referring now with specific detail to FIG. 4, it will be noted that the first and second flanges 54 and 56 of the first and second closure assemblies 48 and 50 are connected to the first and second panels 22 and 24 at discrete locations. In other words, an outer surface 88 of the first flange 54 is not entirely in engagement with either of the first panel 22 or the second panel 24. Similarly, the outer surface 90 of the second flange 56 is also not in full engagement with the either the first panel 22 or the second panel 24. Rather the first flange 54 is connected to the first panel 22 at a lamination point 92, while the second flange 56 is connected to the second panel 24 at a lamination point 94. In so doing, it will be seen that a first vent space 96 is formed between a first panel 22 and the first flange 54, while a second space 98 is formed between the second flange 56 and the second panel 24.

The second closure assembly 50 is substantially identical to the first closure 48 but for the reverse orientation of the extended and recessed profiles 60 and 62. In other words, it can be seen in FIGS. 2-4 that as opposed to the extended profile 60 being attached to the first flange 54, it is in fact attached to the second flange 56. Similarly, the recessed profile 62 is attached to the first panel 54 as opposed to the second panel 56 as was the case with respect to the first closure assembly 48. In addition, the first and second closure assemblies 48 and 50 are attached between the first and second flanges 54 and 56 at a dimension sufficient to form an evacuation zone 100. More specifically, the evacuation zone 100 is flanked by the first closure assembly 48 and second closure assembly 50 along a longitudinal axis 102 and by the first flange 54 and the second flange 56 along the lateral axis 104. Within a section of the first flange 54 forming part of the evacuation zone 100, at least one venting aperture 106 is formed, whereas in the section of the second flange 56 forming the evacuation zone 100, a second venting aperture 108 is formed. While in the depicted embodiment two venting apertures are shown, it is to be understood that in other embodiments, a greater number of apertures can be provided, with some or all of the apertures having an associated valve.

By positioning the elements as described above and depicted in FIGS. 2-4, a closure system 46 is formed which allows for first and second zipper mechanisms to be used to substantially seal the interior storage space 44 from the atmosphere 110. In addition, by providing the first and second closure assemblies 48 and 50 on first and second flanges 54 and 56 and connecting the first and second flanges 54 and 56 at discrete lamination points 92 and 94 to either the first panel 22 or the second panel 24, but not both, an evacuation pathway 112 (as shown in FIG. 4) for air within the interior storage space 44 to escape the bag 20 even after the first and second closure assemblies 48 and 50 are sealed is formed. More specifically, after the bag 20 is sealed by the first and second closure assemblies 48 and 50, the air can escape the interior storage space 44 by first entering first evacuation space 96 formed between the first flange 54 and the first panel 22. The air can then escape by way of the first venting aperture 106 into the evacuation zone 100 formed by the closure system 46. Following arrow 112, the air can then further escape the evacuation zone 100 by way of the second venting aperture 108 formed in the second panel 56 and then into the second vent space 98 formed between the first flange 54 and the first panel 22. The air can then fully escape the bag to the atmosphere 110. While not depicted, the interior surface of the bag 20 proximate the zippers 48, 50 can be embossed, textured, or otherwise treated to facilitate separation of the bag panels from the zipper in the areas of the vent spaces 96, 98 to allow air within the bag to escape.

In order to substantially seal the bag 20 and maintain the freshness of the contents therein, as well as the physical retention of the air or fluid within the bag 20, the evacuation zone 100 can be temporarily sealed by the valve 52. In the depicted embodiment, the valve 52 is a flap valve 118 formed by a movable appendage which can allow for fluid communication between the first and second venting apertures 106 and 108 when in an open configuration, and substantially close off communication between the first and second venting apertures 106 and 108 when in a closed configuration. The flap valve 118 can be made from the same material as the bag 20 or zippers 48, 50 or the same material. The flap valve 118 may be extruded separately from the material used to make the bag and/or the zippers.

Referring first to FIG. 4, the depicted embodiment includes a valve flap 118 connected to the first flange 54 at hinge 120. More specifically, the hinge 120 is formed between the valve flap 118 and the interior surface 122 of the first flange 54. In the closed configuration of FIG. 2, the valve flap 118 lays substantially parallel to the first and second flanges 54 and 56 and, in so doing, overlies the first venting aperture 106 thereby closing off communication through the evacuation zone 100. However, in the open configuration depicted in FIG. 4, the valve flap moves substantially away from the second venting aperture 108 thereby allowing for fluid communication through the evacuation zone 100 as described above. The valve flap 118 may be manufactured from the same polymeric materials as the remainder of the bag and should have sufficient flexibility so as to be moveable between the closed and open configurations simply upon application of sufficient pressure on the bag 20 after the closure system 46 is closed. In other words, after the bag 20 is closed by engaging the first and second closure assemblies 48 and 50, a user can compress the first panel 22 and second panel 24 together to squeeze any remaining air within the bag out of the interior storage space 44. The pressure generated by such action of a user is sufficient to push the valve flap 118 away from the venting aperture 106 and from thereon exit the bag along the direction of arrow 112. In alternative embodiments, the air can be evacuated through the use of a vacuum pump or the like. Accordingly, as opposed to a user squeezing the bag, an inlet hose from the vacuum can be connected to the venting aperture 108 to actively draw the air out of the bag. A coupling (not shown) could be provided proximate the aperture 108 to facilitate the process.

Figure 5:
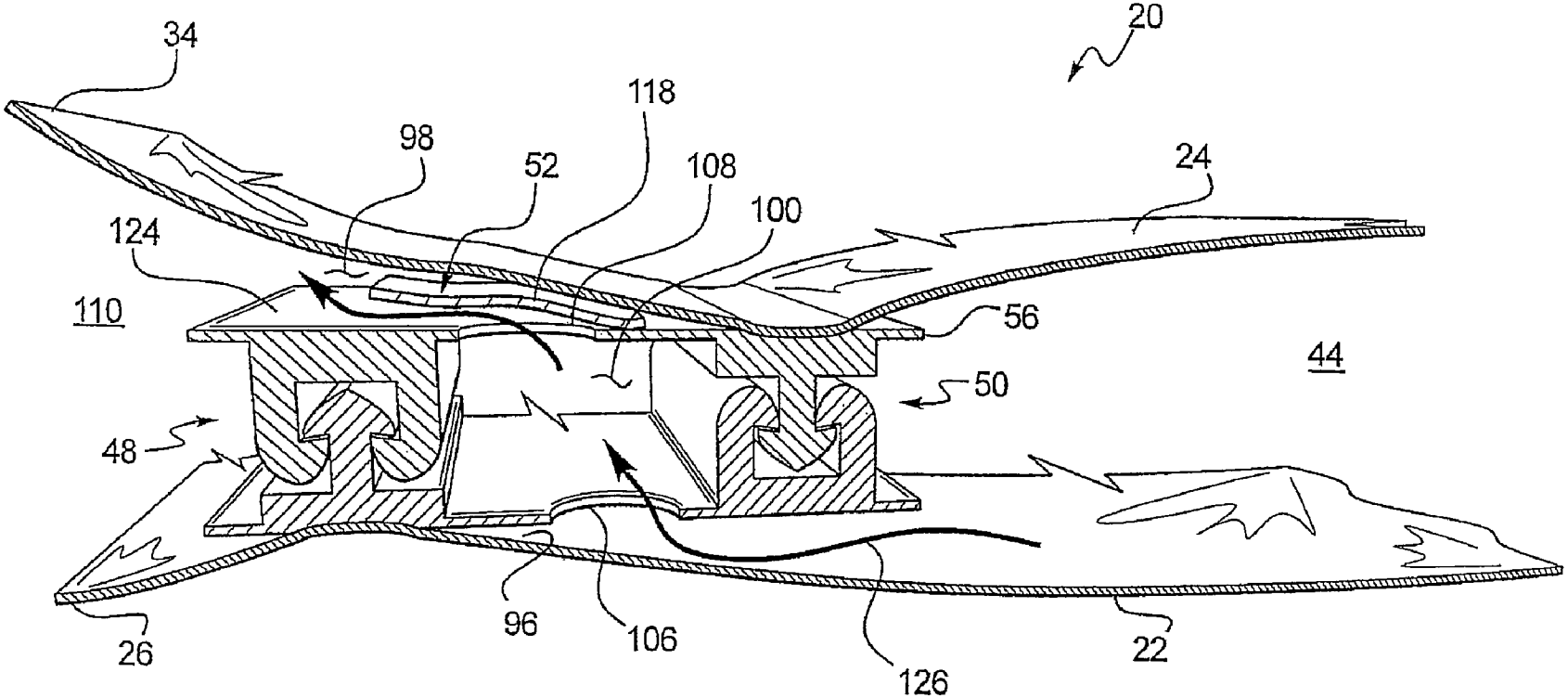
FIG. 5 is an enlarged sectional view of a closure of a second embodiment.
Figure 6:
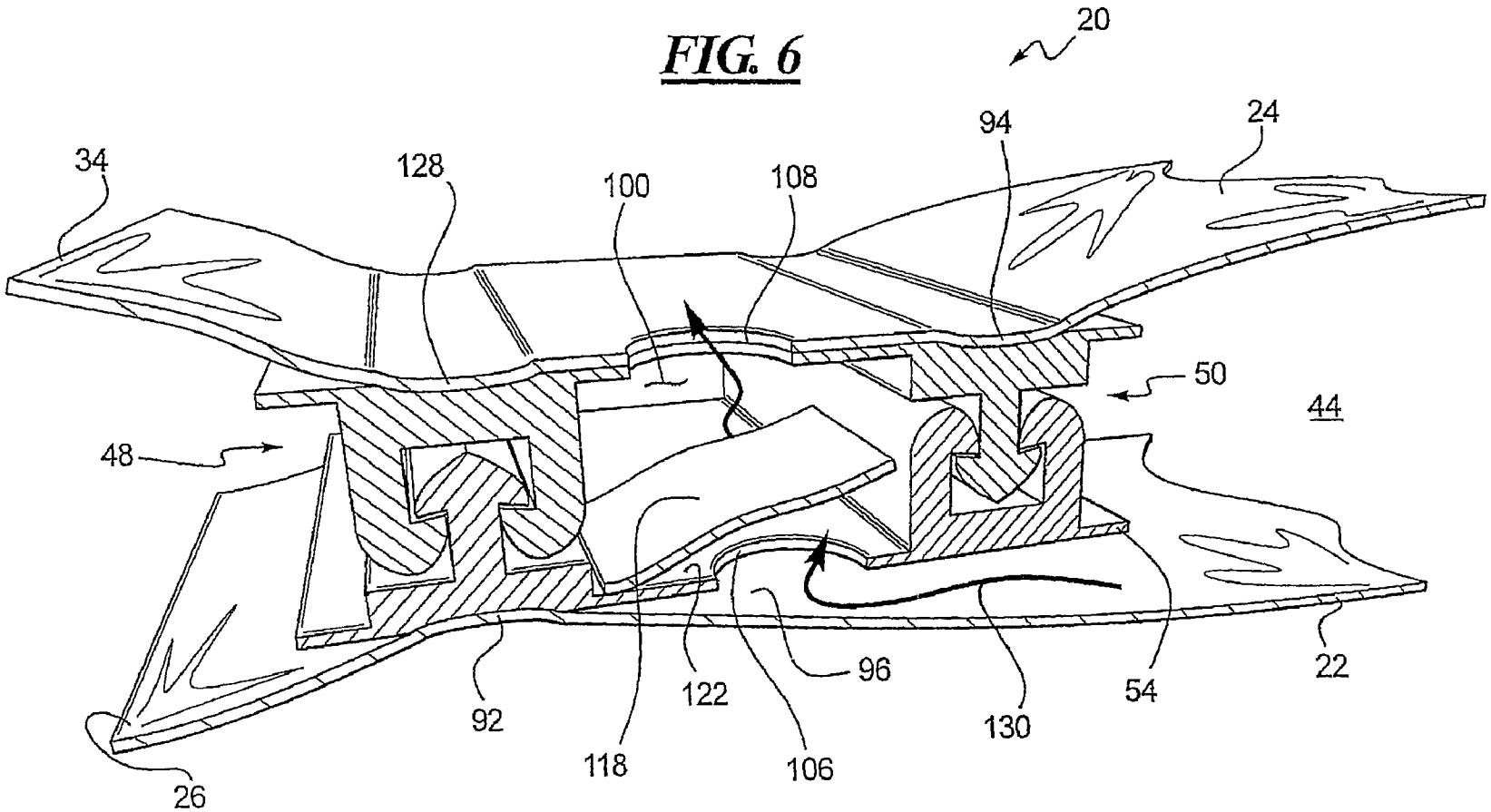
FIG. 6 is an enlarged sectional view of a closure of a third embodiment.
Figure 7:
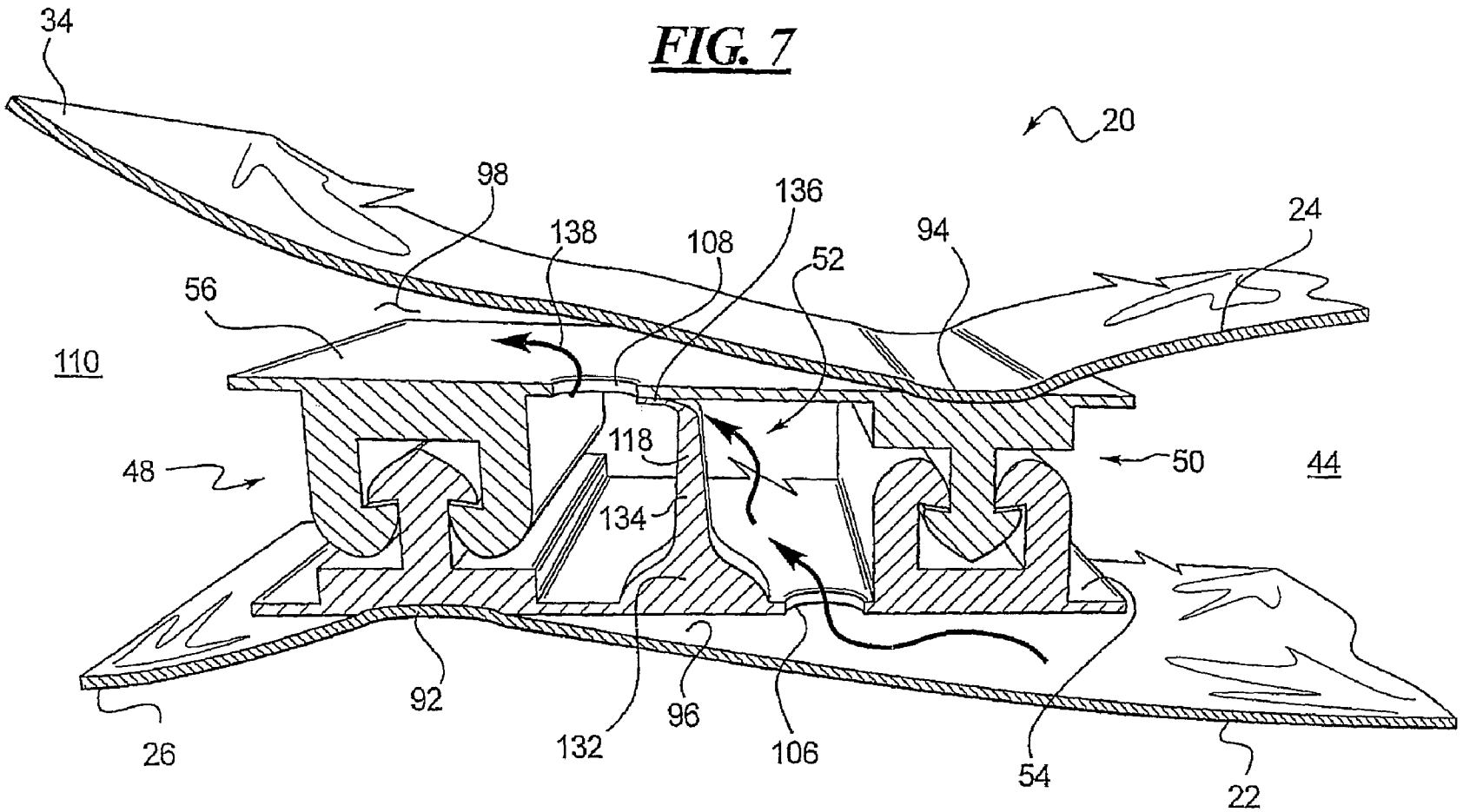
FIG. 7 is an enlarged sectional view of a closure of a fourth embodiment.

Referring to FIGS. 5-7, they disclose a closure system 46 substantially similar to that of FIGS. 1-3 but for either the location of the valve flap 118, or the location of the lamination points 92 and 94, or the specific form of the valve 116 provided. Each of the embodiments, however, employs the same basic principles providing first and second closure assemblies to provide a well sealed bag 20 but still providing for evacuation of air or fluid contained within the bag even after the seal has been made by first and second closure assemblies.

With reference first to FIG. 5, it is substantially similar to the embodiment of FIG. 4 but for the location of the valve 52. As shown therein, the valve flap 118 is not attached to an interior surface 122 of the first flange 54 but rather is connected to an exterior surface 124 of the second flange 56. Accordingly, when pressure is generated within the interior storage space 44 of the bag 20, the air follows arrow 126 first into the first evacuation space 96, then through the first venting aperture 106, then through the evacuation zone 100, then through the second venting hole 108, then into the second evacuation space 98, and then into the atmosphere 110. One difference with respect to the first embodiment is that the valve flap 118 is opened as a relatively late step in the evacuation process.

With respect to FIG. 6, the valve flap 118 of its configuration is provided in the same location as the first embodiment, i.e., against an interior surface 122 of the first flange 54. A difference of FIG. 6 is that three lamination points are provided as opposed to two. As will be noted with respect to FIGS. 1-5, in the first two embodiments, first and second lamination points 92 and 94 were formed between first panel 22 and first closure assembly 48, and second panel 24 and second closure assembly 50, respectively. However, in the embodiment of FIG. 6, a third lamination point 128 is provided. In so doing, it can be seen that the second flange 56 is substantially laminated or otherwise connected to the second panel 24 across substantially its entire dimension. One consequence of such structure is that the second evacuation space 98 is not formed, but only the first evacuation space 96 is formed. Following evacuation arrow 130, air from the interior storage space 44 first enters the first evacuation space 96, and then enters the evacuation zone 100 through first venting aperture 106. In so doing, the valve flap 118 is pushed away from the aperture 106 allowing the air to enter the evacuation zone 100. The air exits the evacuation zone 100 through the second venting aperture 108 with no additional valve being provided. Rather, the air exits the evacuation zone 100 and into the atmosphere 110 directly through the second venting aperture 108.

With respect to the embodiment of FIG. 7, it is similar to the embodiments of FIGS. 4 and 5 with regard to the location of the lamination points 92 and 94, as well as the formation of the evacuation spaces 96 and 98. Differences lie with respect to the form of the valve 52 provided. The valve 52 is again a flap valve provided by way of valve flap 118, but as opposed to the embodiments of FIGS. 4-6, the valve flap 118 lies substantially perpendicular to the first and second flanges 54 and 56 in a closed configuration. As will be recalled, the valve flap 118 of the first three depicted embodiments is substantially parallel to the first and second flanges 54 and 56 when in a closed configuration. However, the valve flap 118 of the embodiment of FIG. 7 includes a mounting base or hinge 132 and a valve body 134 which extends from the first flange 54 to the second flange 56 and terminates in an engagement tip 136. When closed, the engagement tip 136 fully contacts the second flange 56 but when sufficient pressure is generated within the interior storage space 44 and forced out of the bag 20, the valve flap 118 hinges about mounting base 132 thereby pushing the engagement tip 136 away from the second flange 56 and thereby creating the evacuation pathway 138. While not depicted, it is to be understood that a still further embodiment could be provided by mounting the valve body 134 to the second flange 56 and causing the engagement tip 136 to engage the interior surface 22 of the second flange 56 when in a closed position.

Figure 8:
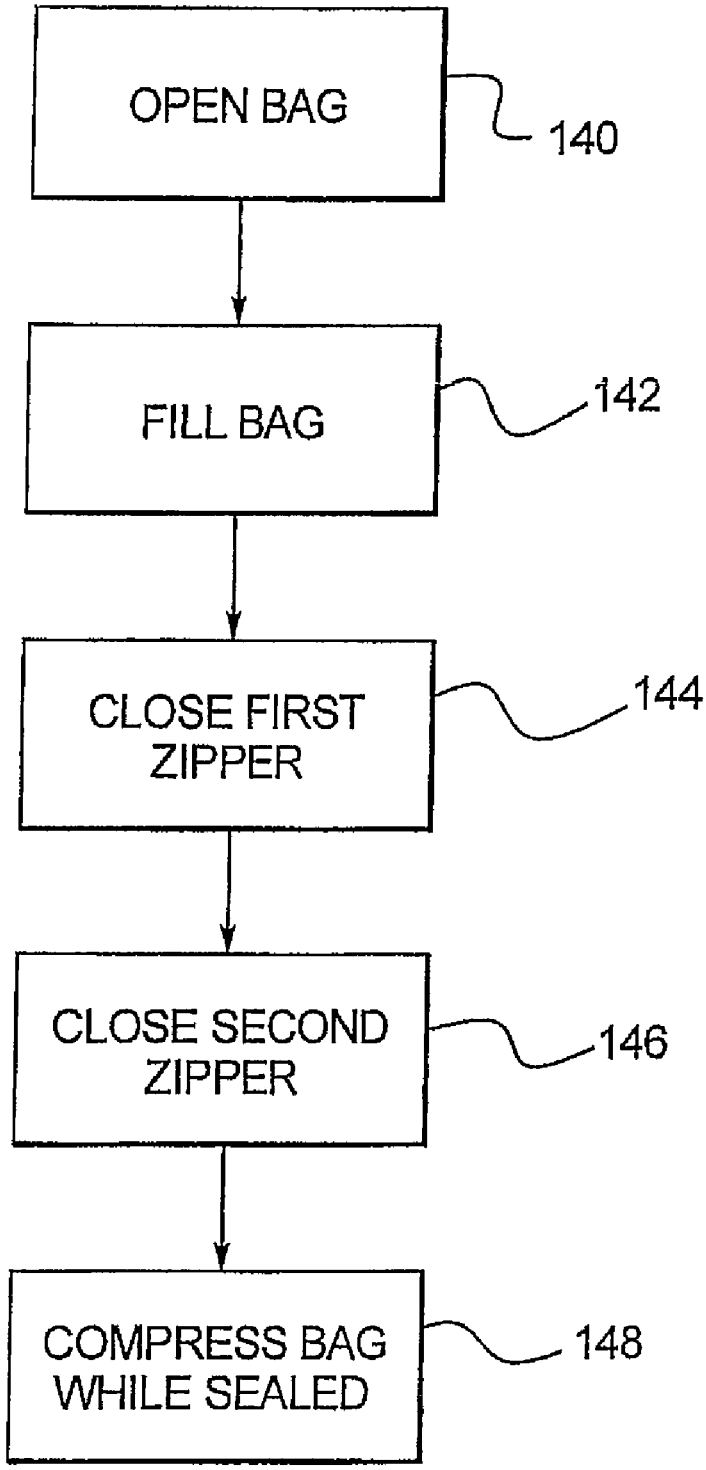
FIG. 8 is a flow chart depicting a sample sequence of steps which can be taken in conjunction with the teachings of the present disclosure.

Finally, with respect to FIG. 8, a sample sequence of steps which can be used in practicing the method of the present disclosure is depicted in a flow chart format. As shown, in a first step 140, the bag 20 is opened by the user. This can be accomplished by the user grabbing the top edges 26 and 34 of the bag and pulling them laterally apart thereby allowing for access into the interior storage space 44. In a second step 142, the user then loads the bag 20 with the desired contents. In a third step 144, one of the first and second closure assemblies 48 and 50 can be engaged. For example, the user can pinch the extended and recessed profiles 60 and 62 of the first closure assemble 48 together and by drawing the thumb and forefinger across the width of the bag 20, substantially engage the first closure assembly 48. In a fourth step 146, the second closure assembly 50 can be similarly closed. While not depicted, it can be understood that if the first and second closure assemblies 48 and 50 are sufficiently close together, or if the user's fingers are sufficiently large, the first and second closure assemblies 48 and 50 can be simultaneously closed. In a fifth step 148, the user can remove excess air from within the bag 20. This can be accomplished simply by applying manual pressure or compression to the first and second panels 22 and 24, thereby squeezing air or fluid from the interior storage space 44 out of the bag 20. In so doing, sufficient pressure is generated within the interior space 44 so as to cause the valve 52 to open and thereby create an evacuation pathway through the closure system 46 as described above. After the user sufficiently compresses the bag 20, his or her hands can be removed from the bag, thereby removing the excess pressure from within the bag, and thereby causing the valve 52 to return to its closed configuration. As indicated above, the air could be evacuated using a vacuum pump as opposed to hand pressure. In addition, while not depicted, one of the zippers 48, 50 can be closed, the air within the bag can then be evacuated or vented, and then the other zipper 48, 50 can be closed.

From the foregoing, it can be understood that the teachings of the present disclosure can be used to manufacture a bag having substantially enhanced sealing capabilities in that first and second closure assemblies are provided. In addition, even after closing the bag, a convenient and effective mechanism for evacuating any excess air from within the bag is provided by way of a vent with or without a movable valve within the closure system itself.

What is claimed is:

1. A reclosable storage bag, comprising:

a first panel having top, bottom, left and right edges, the first panel having inner and outer surfaces;

a second panel having top, bottom, left and right edges, the second panel having inner and outer surfaces, the second panel being secured to the first panel along the bottom, left and right edges of each panel, the inner surface of the first panel being adjacent the inner surface of the second panel when secured thereto;

a first closure member having an extended profile and a recessed profile, the first closure member extended profile being on a first flange and secured to the inner surface of the first panel proximate the first panel top edge, the first closure member recessed profile being on a second flange and secured to the inner surface of the second panel proximate the second panel top edge;

a second closure member having an extended profile and a recessed profile, the second closure member extended profile being on the second flange and secured to the inner surface of the second panel, the second closure member recessed profile being on the first flange and secured to the inner surface of the first panel;

the first flange attached to the first panel only along an area adjacent the first closure member;

the second flange attached to the second panel only along an area adjacent the second closure member; and a vent positioned between the first and second closure members.

2. The reclosable storage bag of claim 1, wherein first and second flanges and first and second closure members are provided between and are laminated to the first and second panels.

3. The reclosable storage bag of claim 2, further including a valve proximate the vent.

4. The reclosable storage bag of claim 3, wherein the valve is on an outer surface of one of the first and second flanges.

5. The reclosable storage bag of claim 3, wherein the valve is on an inner surface of one of the first and second flanges.

6. The reclosable storage bag of claim 3, wherein the valve is a flap valve.

7. The reclosable storage bag of claim 6, wherein the flap valve is perpendicular to the first and second flanges when in a closed position.

8. The closable storage bag of claim 6, wherein the flap valve is parallel to the first and second flanges when in a closed position.

9. A reclosable storage bag, comprising:

a first panel;

a second panel secured to the first panel along left, bottom, and right edges leaving an open top edge and defining an interior storage space between the first and second panels;

a bag closure secured across the top edge, the bag closure including a first flange having at least one venting aperture therein, a second flange having at least one venting aperture therein, a first zipper disengagably attaching the first flange to the second flange, a second zipper disengagably attaching the first flange to the second flange with the first and second zippers flanking the venting apertures in the first and second flanges, the first flange being attached to the first panel only along an area adjacent the first zipper and thereby forming a first evacuation space between the first flange and the first panel, the second flange being attached to the second panel only along an area adjacent the second zipper and thereby forming a second evacuation space between the second flange and second panel; and a flap valve hingedly attached to the bag and extending between the first flange venting aperture and the second flange venting aperture, the valve being movable between open and closed positions when first and second zippers are engaged, the bag including an air evacuation pathway when the valve is in the open position, the air evacuation pathway leading from the interior storage space to the first evacuation space, through the first flange venting aperture, through the second flange venting aperture, through the second evacuation space, and to the atmosphere.

10. The reclosable storage bag of claim 9, wherein the valve is a flap valve.

11. The reclosable storage bag of claim 10, wherein the flap valve is parallel to the first and second flanges when in a closed position.

12. The reclosable storage bag of claim 10, wherein the flap valve is perpendicular to the first and second flanges when in a closed position.

13. The reclosable storage bag of claim 9, wherein the first and second zippers each include an extended profile strip and a recessed profile strip.

14. The reclosable storage bag of claim 13, wherein one extended profile strip is attached to the first flange and one extended profile strip is attached to the second flange.

15. The reclosable storage bag of claim 10, wherein the flap valve is on an inner surface of one of the first and second flanges.

16. The reclosable storage bag of claim 9, wherein the first and second flanges are laminated to the first and second panels only at discrete points.

17. The reclosable storage bag of claim 16, wherein the first flange is laminated to the first panel adjacent the first zipper, and the second flange is laminated to the second panel adjacent the second zipper.

* * * * *